US007607471B2

(12) United States Patent
Saika et al.

(10) Patent No.: US 7,607,471 B2
(45) Date of Patent: Oct. 27, 2009

(54) TEMPERATURE CONTROL DEVICE

(75) Inventors: Masao Saika, Tsukubamirai (JP); Takayuki Harada, Tsukubamirai (JP); Takahiro Ono, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 181 days.

(21) Appl. No.: 11/582,337

(22) Filed: Oct. 18, 2006

(65) Prior Publication Data

US 2007/0095516 A1 May 3, 2007

(30) Foreign Application Priority Data

Oct. 28, 2005 (JP) ..... 2005-314715

(51) Int. Cl.
*F28D 7/10* (2006.01)

(52) U.S. Cl. ..... 165/163; 165/200; 165/155; 165/156; 165/160

(58) Field of Classification Search ..... 165/154, 165/155, 156, 160, 165, 166, 164, 200, 163
See application file for complete search history.

(56) References Cited

U.S. PATENT DOCUMENTS 2,127,732 A * 8/1938 Heitman ..... 165/160
2,324,395 A * 7/1943 Hoop ..... 62/163
3,526,273 A * 9/1970 Wentworth, Jr. ..... 165/74
4,257,479 A * 3/1981 Newton ..... 165/156
6,345,508 B1 * 2/2002 Bodhaine et al. ..... 62/50.3

FOREIGN PATENT DOCUMENTS

| | | |
|---|---|---|
| CH | 681 832 A5 | 5/1993 |
| DE | 93 09 718 | 11/1993 |
| JP | 2000-75935 | 3/2000 |
| JP | 2000075935 A | 3/2000 |
| JP | 2005-127608 | 5/2005 |

* cited by examiner

*Primary Examiner*—Teresa J Walberg
(74) *Attorney, Agent, or Firm*—Oblon, Spivak, McClelland, Maier & Neustadt, L.L.P.

(57) ABSTRACT

In a temperature control device, a plurality of screening cylinders each having a different diameter are concentrically arranged within a liquid tank to concentrically form a plurality of layered channels which are communicated to define a circulation passage through which constant-temperature fluid flows. A heat transfer tube through which liquid chemical flows is disposed in any one of the channels such that heat exchange between the liquid chemical and the constant-temperature fluid is performed via the heat transfer tube for controlling temperatures of the liquid chemical.

9 Claims, 4 Drawing Sheets

TEMPERATURE CONTROL DEVICE

TECHNICAL FIELD

The present invention relates to a temperature control device provided with a circulation passage that allows constant-temperature fluid to flow circularly therethrough and a heat transfer tube provided in the circulation passage and allows a liquid chemical to flow therethrough for exchanging heat between the constant-temperature fluid and the liquid chemical via the heat transfer tube so as to control liquid chemical temperatures.

BACKGROUND ART

A temperature control system that includes a liquid tank which keeps the contents thereof at a constant temperature has been widely used. Recently, in a certain type of the temperature control device, a heat exchanger equipped with a thermo-module that controls temperatures using Peltier effect has been provided for the liquid tank (for example, see Japanese Unexamined Patent Application Publication No. 2000-75935). The heat exchanger equipped with the thermo-module is capable of switching the temperature control between heating and cooling by simply changing the direction where electric current is applied. The aforementioned heat exchanger, thus, may be compact, and especially suitable for the use in a compact liquid tank.

The temperature control device disclosed in the prior art publication noted above includes a liquid tank in which the temperature of a heat exchange medium filled therein is controlled by a heat exchanger equipped with the thermo-module, and a coil tube disposed within the liquid tank. In the temperature control device, heat exchange between the liquid chemical flowing through the coil tube and the heat exchange medium is performed for controlling temperatures, and a stirring bar on the bottom stirs the heat exchange medium so as to be kept at a constant temperature.

In the aforementioned temperature control device, however, the coil tube is simply immersed into the tank filled with the heat exchange medium that is stirred by the stirring bar. It is, thus, difficult to efficiently perform the heat exchange between the liquid chemical flowing through the coil tube and the heat exchange medium.

Another known temperature control device that controls temperatures of fluid within the tank using the heat exchanger equipped with the thermo-module has been introduced, which includes an outer tank that stores the fluid, an inner tank provided within the outer tank leaving a gap therefrom, having a channel formed in its side wall for accommodating an inflow of the fluid, and an opening formed at the center of its bottom, a container immersed in the fluid within the inner tank for storing the liquid chemical subjected to the temperature control, and a stirring member that guides the fluid accommodated through the opening of the bottom of the inner tank toward the upward direction via a space between the side walls of the inner and the outer tanks using a rotary blade provided at the center of the bottom of a portion between the outer and the inner tanks. The thermo-module of the heat exchanger is attached to the outer surface of the side wall of the outer tank such that the temperature of the fluid flowing through the space between the inner and the outer tanks is controlled to a predetermined temperature based on the output of a temperature sensor that detects the fluid temperature (see, for example, Japanese Unexamined Patent Publication No. 2005-127608).

In the aforementioned temperature control device, a container that stores the liquid chemical subjected to the temperature control is disposed within the inner tank such that heat is transferred from the constant-temperature fluid within the inner tank to the liquid chemical. This may cause the problem of taking much time for stabilizing the temperature of the liquid chemical.

DISCLOSURE OF INVENTION

Accordingly, it is an object of the present invention to provide a temperature control device capable of performing efficient heat exchange between a constant-temperature fluid under the temperature control and a liquid chemical subjected to the temperature control while reducing the size of the system, thus allowing easy and quick temperature control of the liquid chemical to the constant temperature.

It is another object of the present invention to provide a temperature control device that allows a space-saving long circulation channel to be easily formed within the liquid tank.

The temperature control device according to the present invention includes a liquid tank provided with a circulation passage through which a constant-temperature fluid circularly flows, and a heat transfer tube provided in the circulation passage, through which liquid chemical flows such that a heat exchange between the liquid chemical and the constant-temperature fluid is performed via the heat transfer tube for controlling a temperature of the liquid chemical. In the temperature control device, the circulation passage is defined by a plurality of concentrically layered channels each screened by concentrically arranging a plurality of screening cylinders each having a different diameter around a center axis of the liquid tank, and adjacent channels among them are communicated at opposite axial ends alternately, and the inner most channel is communicated with the outer most channel through a communication passage that extends along a bottom wall of the liquid tank. The heat transfer tube includes an inlet tube end through which a flow of the liquid chemical is accommodated, an outlet tube end through which the liquid chemical is discharged, and at least one spiral heat transfer coil connected to the tube end so as to be concentrically disposed within the channel. A pump is provided at a center position of a bottom of the liquid tank for circulating the constant-temperature fluid along the circulation passage.

In the present invention, preferably, a part of the plurality of screening cylinders is disposed in the liquid tank, and the remaining part is attached to an upper lid that detachably covers an upper portion of the liquid tank, and the heat transfer tube is attached to the upper lid.

Specifically, a circular screening plate is provided inside the liquid tank such that the communication channel is defined by the screening plate and a bottom wall of the liquid tank. The plurality of screening cylinders are formed of the inner screening cylinder with a small diameter, the outer screening cylinder with a large diameter, and the intermediate screening cylinder with an intermediate diameter, the inner screening cylinder and the outer screening cylinder are directed upward to be attached to inner and outer circumferences of the screening plate, and the intermediate screening cylinder is directed downward to be attached to the upper lid so as to be interposed between the inner screening cylinder and the outer screening cylinder.

In this case, the circulation passage is formed of the channel between a side wall of the liquid tank and the outer screening cylinder, the channel defined by the outer screening cylinder and the intermediate screening cylinder, the channel defined by the intermediate screening cylinder and the inner screening cylinder, the channel inside the inner screening cylinder, and the communication passage.

In the present invention, the heat transfer tube includes a plurality of concentrically arranged heat transfer coils each having a different diameter, so as to be stored individually in the plurality of channels of the circulation passage.

Alternatively, the system may be structured such that a container filled with the liquid chemical is disposed in the screening cylinder at an inner most position, and kept so as to be spaced from an inner surface of the screening cylinder to form a gap for feeding the constant-temperature fluid, and the inlet tube end of the heat transfer tube is extended to the position at which the inlet tube end is immersed in the liquid chemical of the container.

In the present invention, preferably, the liquid tank includes a heat exchanger for adjusting a temperature of the constant-temperature fluid.

In the temperature control device with the aforementioned structure, the circulation passage is formed by arranging a plurality of screening cylinders each having a different diameter concentrically within the liquid tank. This makes it possible to easily form a long circulation passage for the heat exchange within the limited space inside the liquid tank. The aforementioned structure and the pump provided in the liquid tank for circulating the constant-temperature fluid along the circulation passage make it possible to appropriately raise the flow rate of the constant-temperature fluid flowing around the heat transfer tube within the circulation passage. Accordingly, the heat exchange between the constant-temperature fluid and the liquid chemical flowing through the heat transfer tube may be efficiently performed, resulting in easy and quick temperature control of the liquid chemical to the constant temperature.

In this manner, the temperature control device according to the present invention is capable of performing efficient heat exchange between the constant-temperature fluid under the temperature control and the liquid chemical subjected to the temperature control while reducing the size of the system, resulting in easy and quick temperature control of the liquid chemical to the constant temperature. Also, the long circulation passage may be easily formed within the liquid tank while saving the space of the system.

BEST MODE FOR CARRYING OUT THE INVENTION

Figure 1:
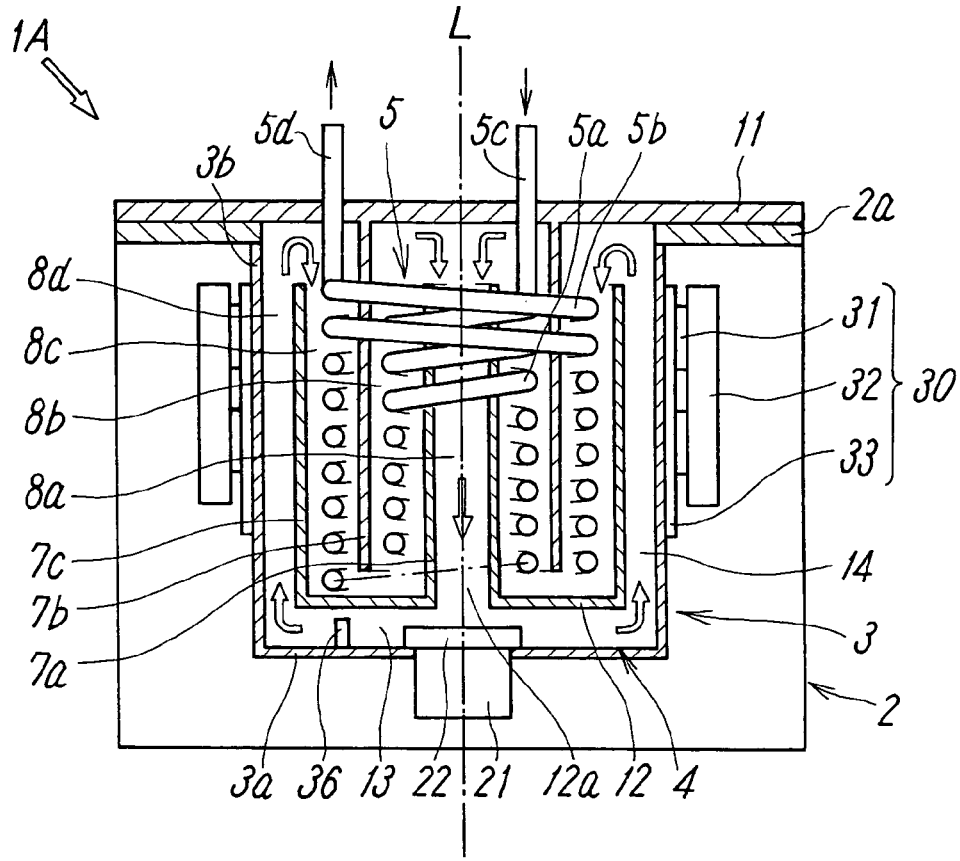
FIG. 1 is a longitudinal sectional view showing an essential portion of a temperature control device according to a first embodiment of the present invention.

Embodiments of a temperature control device according to the present invention will be described in detail referring to the drawings.

FIGS. 1 to 4 show a temperature control device according to a first embodiment of the present invention. A temperature control device 1A is provided with a liquid tank 3 in which temperature-constant fluid contained therein is controlled to a constant temperature by a heat exchanger 30 equipped with a thermo-module 31, a circulation passage 4 formed within the liquid tank 3 that allows the temperature-constant fluid to flow therethrough, a heat transfer tube 5 including spiral heat transfer coils 5*a* and 5*b* provided within the circulation passage 4, a casing 2 that contains the liquid tank 3, and a pump 21 disposed at the center of a bottom wall 3*a* of the liquid tank 3 for circulating the constant-temperature fluid along the circulation passage 4.

In FIG. 1, the direction of the liquid chemical flowing through the heat transfer tube 5 is illustrated by thin arrows, and the direction of the constant-temperature fluid circulating through the circulation passage is illustrated by an outline arrow, respectively. As the liquid chemical to be fed into the heat transfer tube 5, for example, the liquid chemical used for MO-CVD (metalorganic chemical vapor deposition) device may be employed, but not limited thereto.

Figure 3:
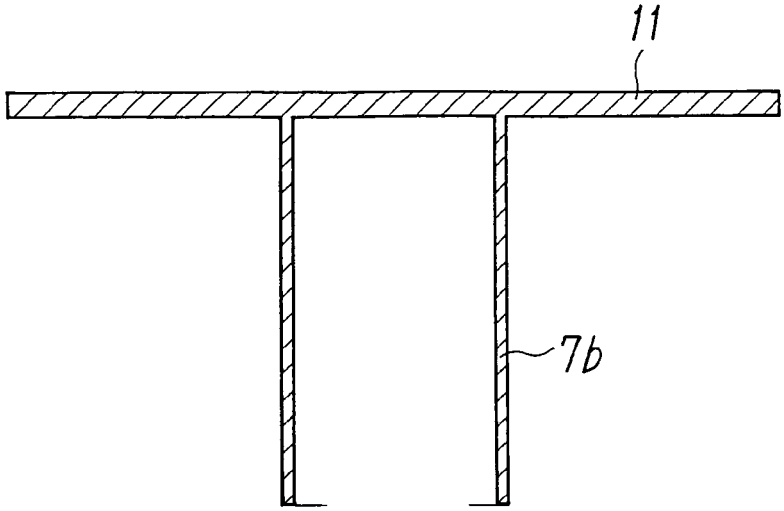
FIG. 3 is a longitudinal sectional view showing an upper lid employed in the first embodiment.
Figure 4:
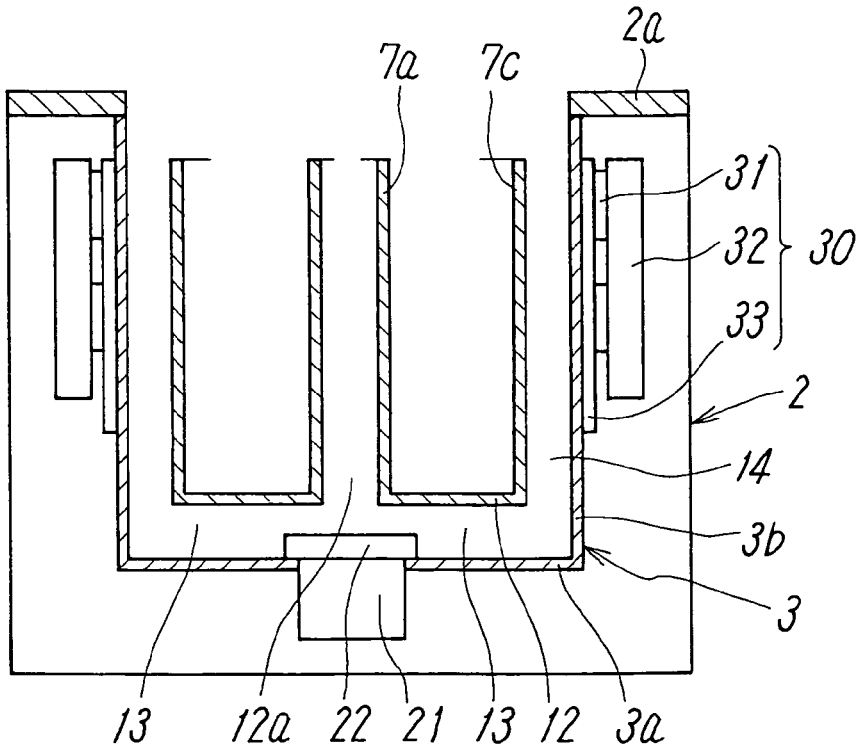
FIG. 4 is a longitudinal sectional view of a structure including a liquid tank and a casing employed in the first embodiment.

An explanation with respect to the temperature control device 1A will be further described in detail. Referring to FIGS. 1, 3 and 4, the liquid tank 3 is formed like a cylinder with its upper portion opened and the bottom portion closed, and is kept within the casing 2. An upper lid 11 is detachably attached to an upper wall 2*a* of the casing 2.

Figure 2:
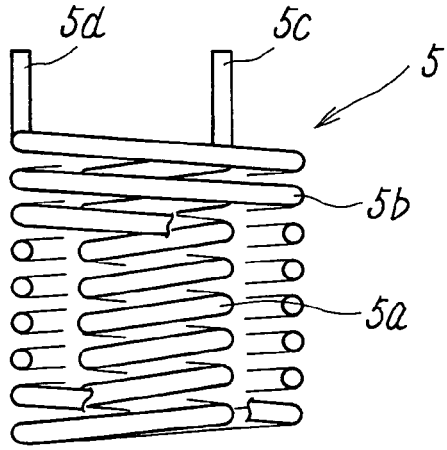
FIG. 2 is a partially broken-out sectional front view of a heat transfer tube employed in the first embodiment.

The heat transfer tube 5 includes the spiral heat transfer coils 5*a* and 5*b* each having a different diameter, which are concentrically disposed as shown in FIGS. 1 and 2. The heat transfer tube 5 further includes an inlet tube end 5*c* communicated with an upper end of the inner heat transfer coil 5*a* as a smaller diameter portion for accommodating an inflow of the liquid chemical, and an outlet tube end 5*d* communicated with an upper end of the outer heat transfer coil 5*b* as a larger diameter portion for discharging the liquid chemical. Those two heat transfer coils 5*a* and 5*b* are communicated with each other at the respective lower ends.

Each of the inlet and the outlet tube ends 5*c* and 5*d* has a linear shape, and pierces through the upper lid 11 to protrude upward so as to support the heat transfer tube 5 at the upper lid 11.

The heat exchanger 30 is formed by stacking the thermo-modules 31 that perform the heat control using Peltier effect, a heat transfer plate 33 that transfers heat through a side wall 3*b* of the liquid tank 3, and a heat release portion 32 that allows cooling water or the like to flow therethrough. A temperature sensor 36 is attached to the bottom wall 3*a* of the liquid tank 3 for detecting the temperature of the fluid within the liquid tank 3. The thermo-module 31 and the temperature sensor 36 are connected to a not shown controller that controls the temperature of the fluid within the liquid tank 3 to a predetermined temperature based on an output of the temperature sensor 36.

The aforementioned heat exchanger 30, the temperature sensor 36, and the controller for the thermo-module 31 form a temperature control unit for controlling the temperature of the constant-temperature fluid within the liquid tank 3.

In this embodiment, the heat exchanger 30 includes four thermo-modules 31 which are attached to the outer surface of the side wall 3*b* of the liquid tank 3 and extend to cover a substantially whole longitudinal length of the side wall 3*b*. However, they may be provided in an arbitrary manner in accordance with temperature control conditions.

The circulation passage 4 is defined by a plurality of concentrically arranged first to fourth channels 8*a* to 8*d* as shown in FIG. 1. Specifically, the inside of the liquid tank 3 is screened by a plurality of screening cylinders 7*a* to 7*c* each having a different diameter, which are concentrically arranged around a center axis L so as to form the concentrically layered plurality of channels 8*a* to 8*d*. The adjacent channels are communicated with each other at opposite axial ends alternately, and the lower end of the inner most first channel 8*a* extending along the axial center L in the center of the liquid tank 3 is communicated with the lower end of the outer most fourth channel 8*d* in a communication passage 13 that extend in the entire circumferential direction along the bottom wall 3*a* of the liquid tank 3, thus forming a single continued flow passage. The aforementioned two heat transfer coils 5*a* and 5*b* of the heat transfer tube 5 are concentrically stored within the second and the third channels 8*b* and 8*c* at positions interposed between the aforementioned channels 8*a* and 8*d*.

A constant gap is maintained between the heat transfer coil 6*a* contained in the channel 8*b* and the wall surfaces of the screening cylinders 7*a*, 7*b* that form the channel 8*b*, and likewise between the heat transfer coil 5*b* and the wall surfaces of the screening cylinders 7*b*, 7*c* that form the channel 8*c*. The distance of the gap may influence the flow rate of the constant-temperature fluid that flows through those gaps. The flow rate of the constant-temperature fluid that flows around the heat transfer coils 5*a* and 5*b* may influence the heat transfer performance. It is, thus necessary to set the distance between wall surfaces of the channels 8*a* to 8*d*, the diameter of the heat transfer tube 5, the distance of the gap in consideration for the relationship between the flow rate of the fluid fed by the pump 21 and the gap such that the flow rate of the constant-temperature fluid flowing around the heat transfer coils 5*a* and 5*b* is controlled to the predetermined flow rate.

In the illustrated embodiment, among the plurality of screening cylinders 7*a* to 7*c*, the screening cylinder 7*a* is an inner screening cylinder with a smaller diameter, the screening cylinder 7*c* is an outer screening cylinder with a larger diameter, and the screening cylinder 7*b* is an intermediate screening cylinder with an intermediate diameter interposed between the screening cylinders 7*a* and 7*c*. Referring to FIGS. 1, 3 and 4, the inner screening cylinder 7*a* and the outer screening cylinder 7*c* are attached to a circular screening plate 12 provided above the bottom wall 3*a* of the liquid tank 3 at a predetermined gap, and extend upward having upper ends opened under the level of the constant-temperature fluid within the liquid tank 3. The intermediate screening cylinder 7*b* is integrally attached to the upper lid 11 to extend downward having its lower end opened at the position slightly above the screening plate 12.

The screening plate 12 has a circular shape and an opening 12*a* formed through the center portion thereof such that the communication passage 13 is defined by the screening plate 12 and the bottom wall 3*a*. The inner screening cylinder 7*a* and the outer screening cylinder 7*c* are attached to inner and outer circumferential edges of the screening plate 12, respectively.

The circulation passage 4 is formed by the communication passage 13 defined by the screening plate 12 and the bottom wall 3*a* of the liquid tank 3, the fourth channel 8*d* defined by the outer screening cylinder 7*c* and the side wall 3*b* of the liquid tank 3, the third channel 8*c* defined by the outer screening cylinder 7*c* and the intermediate screening cylinder 7*b*, the second channel 8*b* defined by the intermediate screening cylinder 7*b* and the inner screening cylinder 7*a*, and the first channel 8*a* inside the inner screening cylinder 7*a*.

The pump 21 includes a rotary blade 22 positioned at the center of the bottom of the liquid tank 3 below the opening 12*a* formed at the center of the screening plate 12. The pump 21 allows the rotary blade 22 to guide the constant-temperature fluid flowing down to the communication passage 13 from the channel 8*a* inside the inner screening cylinder 7*a* through the center opening 12*a* of the screening plate 12 to the communication passage 13 defined by the screening plate 12 and the bottom wall 3*a* of the liquid tank 3. The constant-temperature fluid is guided upward through the fourth channel 8*d* defined by the outermost outer screening cylinder 7*c* and the side wall 3*b* of the liquid tank 3. The flow is guided to fall down from the upper end of the screening cylinder 7*c* through the third channel 8*c* to bypass the lower end of the intermediate screening cylinder 7*b* to reach the second channel 8*b*. It is then guided upward through the second channel 8*b* to bypass the upper end of the inner screening cylinder 7*a*, and further guided to the first channel 8*a* inside the inner screening cylinder 7*a*. The constant-temperature fluid is fed to the communication passage 13 by the pump 21 again.

The heat transfer tube 5 is attached to the upper lid 11 with end portions 5*c* and 5*d* through which the liquid chemical is accommodated and discharged, respectively as described above. The two heat transfer coils 5*a* and 5*b* as the small diameter portion and the large diameter portion, respectively, are disposed inside and outside of the screening cylinder 7*b* attached to the upper lid 11. Those coils extend parallel to the screening cylinder 7*b*.

The plurality of layered channels 8*a* to 8*d* may be defined by the screening cylinders 7*a* and 7*c* in the liquid tank 3, and the screening cylinder 7*b* attached to the upper lid 11 only by attaching the upper lid 11 to the liquid tank 3. The spiral heat transfer coils 5*a* and 5*b* of the heat transfer tube 5 may be contained within the layered channels 8*b* and 8*c*, respectively.

Figure 5:
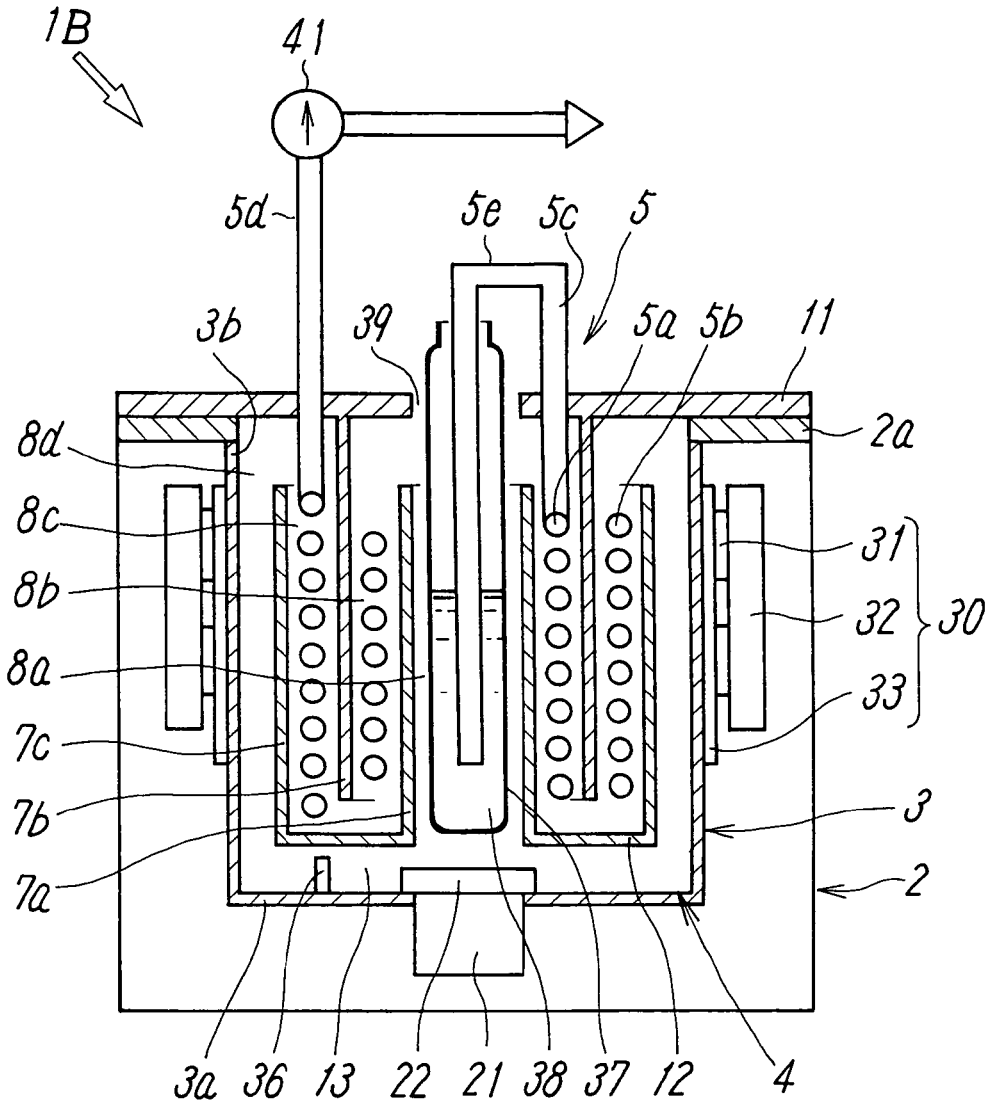
FIG. 5 is a longitudinal sectional view of an essential portion of a temperature control device according to a second embodiment of the present invention.

FIG. 5 shows a temperature control device according to the second embodiment of the present invention. In the temperature control device 1B of the second embodiment, a container 37 filled with liquid chemical 38 is disposed in the inner most screening cylinder 7*a* attached to the inner circumference of the screening plate 12, leaving a gap from the inner surface of the screening cylinder 7*a* such that the liquid chemical is fed from the container 37 to the heat transfer tube 5.

More specifically, a through hole 39 is formed through the upper lid 11 so as to allow the container 37 to pass therethrough. In the state where the container 37 is inserted-into the through hole 39 by causing its lower end to reach the position in the vicinity of the lower end in the screening cylinder 7*a*, the upper end of the container 37 is opened to an atmospheric side above the upper lid 11.

Among the tube ends 5*c* and 5*d* of the aforementioned heat transfer tube 5, both of which are attached to the upper lid 11, the tube end 5*c* through which the liquid chemical flow is accommodated is continued to a suction tube 5*e* having the end portion immersed into the liquid chemical 38 within the container 37. The tube end 5*d* through which the liquid chemical is discharged is connected to a pipe including a pump 41 that sucks the liquid chemical.

In the second embodiment, the liquid chemical in the container 37 within the screening cylinder 7*a* may be preliminarily subjected to the temperature control, thus further improving efficiency in the temperature control.

Since the other structure and operation of the second embodiment are the same as those of the first embodiment as shown in FIG. 1, the same elements as those of the first embodiment will be designated with the same reference numerals, and explanations thereof, thus will be omitted.

Figure 6:
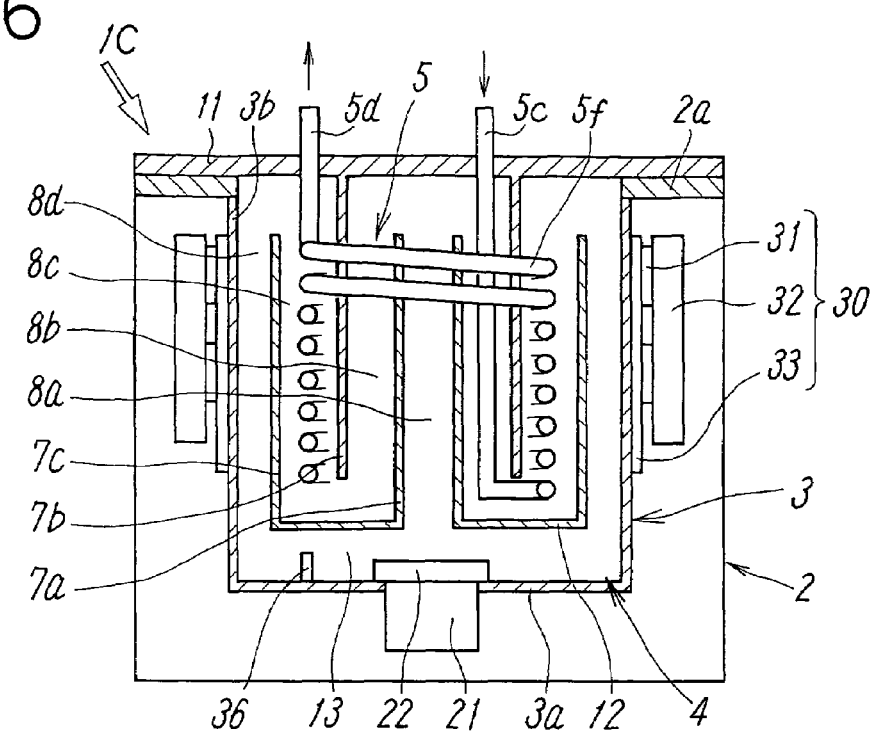
FIG. 6 is a longitudinal sectional view of an essential portion of a temperature control device according to a third embodiment of the present invention.

FIG. 6 shows a temperature control device according to a third embodiment of the present invention. Likewise the first embodiment, the temperature control device 1C has a plurality of layered channels 8*a* to 8*d* defined by the plurality of screening cylinders 7*a* to 7*c* in the liquid tank 3. The aforementioned channels 8*a* to 8*d* and the communication passage 13 form the circulation passage 4. However, the structure of the heat transfer tube 5 is different from that of the first embodiment.

More specifically, compared with the first embodiment in which the heat transfer tube 5 is formed of two spiral heat transfer coils 5*a* and 5*b* as small and large diameter portions, the heat transfer tube 5 in the third embodiment only has a single spiral heat transfer coil 5*f*. The heat transfer coil 5*f* corresponds to the heat transfer coil 5*b* serving as the large diameter portion of the heat transfer tube 5 including the heat transfer coils 5*a* and 5*b* in the first embodiment. Accordingly, the heat transfer coil 5*f* is disposed within the third channel 8*c* outside the intermediate screening cylinder 7*b* attached to the upper lid 11.

The tube end 5*c* of the heat transfer tube 5, through which the liquid chemical flow is accommodated is connected to the lower end of the heat transfer coil 5*f*, and passes through the second channel 8*b* to protrude upward from the upper lid 11. Meanwhile, the tube end 5*d* through which the liquid chemical is discharged is connected to the upper end of the heat transfer coil 5*f*, and passes through the third channel 8*c* to protrude upward from the upper lid 11.

In the third embodiment, as the heat transfer coil 5*f* of the heat transfer tube 5 has a single layer, the heat transfer area becomes smaller compared with the first embodiment. However, as the circulation passage 4 formed in the liquid tank 3 is the same as that formed in the first embodiment, the common device may be employed in accordance with the required temperature control capability.

As the other structure and operation of the third embodiment are the same as those of the first embodiment, the same elements as those shown in FIG. 1 will be designated with the same reference numerals, and explanations thereof, thus will be omitted.

Figure 7:
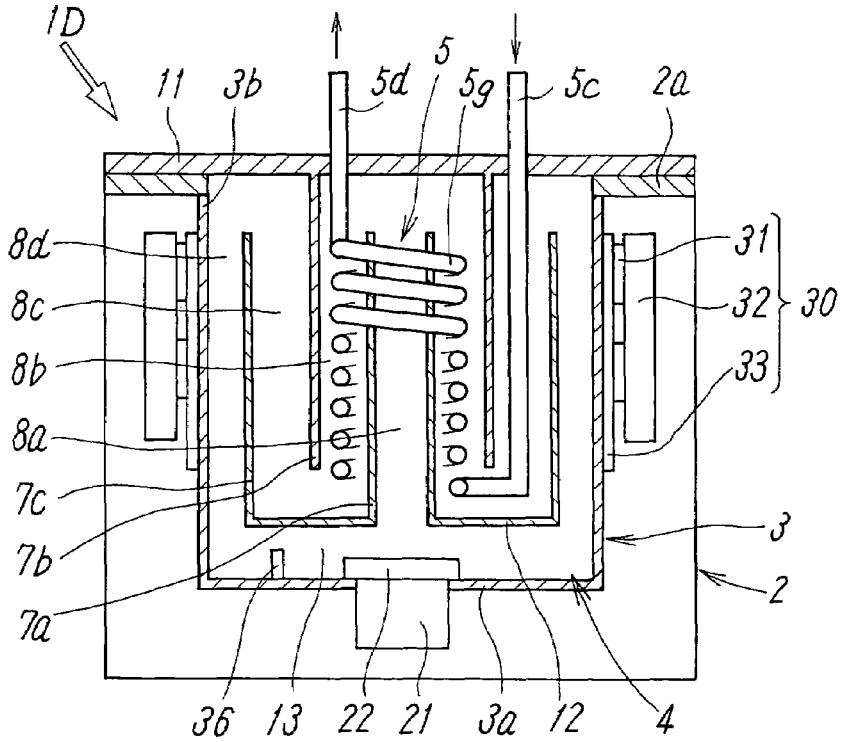
FIG. 7 is a longitudinal sectional view of an essential portion of a temperature control device according to a fourth embodiment of the present invention.

FIG. 7 shows a temperature control device according to a fourth embodiment of the present invention. In the temperature control device 1D of the fourth embodiment, the heat transfer tube 5 includes a single spiral heat transfer coil 5*g*. Such structure, thus, is similar to that of the third embodiment. However, the heat transfer coil 5*g* has a diameter smaller than that of the heat transfer coil 5*f* in the third embodiment, which corresponds to the heat transfer coil 5*a* of the heat transfer tube 5 as the small diameter portion in the first embodiment. Accordingly, the heat transfer coil 5*g* is disposed in the second channel 8*b* inside the intermediate screening cylinder 7*b* attached to the upper lid 11.

The tube end 5*c* of the heat transfer tube 5 through which the liquid chemical flow is accommodated is connected to the lower end of the heat transfer coil 5*g*, and passes through the third channel 8*c* to protrude upward from the upper lid 11. Meanwhile, the tube end 5*d* through which the liquid chemical is discharged is connected to the upper end of the heat transfer coil 5*g*, and passes through the second channel 8*b* to protrude upward from the upper lid 11.

Other structure and operation of the fourth embodiment are the same as those of the third embodiment as shown in FIG. 6. The same elements as those of the third embodiment will be designated with the same reference numerals, and explanations thereof, thus will be omitted.

The circulation passage 4 is formed by concentrically arranging the plurality of the screening cylinders 7*a* to 7*c* each having the different diameter within the liquid tank 3. This makes it possible to easily form the long circulation passage 4 for the heat exchange in the limited space of the liquid tank 3. The aforementioned structure and the pump 21 provided in the liquid tank 3 for circulating the constant-temperature fluid along the circulation passage 4 make it possible to raise the flow rate of the constant-temperature fluid flowing around the heat transfer tube 5 within the circulation passage 4. As a result, the heat exchange between the constant-temperature fluid and the liquid chemical flowing through the heat transfer tube 5 may be sufficiently performed while saving the space of the system, resulting in easy and quick temperature control of the liquid chemical to the constant temperature.

A part of the plurality of screening cylinders 7*a* to 7*c* is disposed in the liquid tank 3, and the remaining part is attached to the upper lid 11. The heat transfer tube 5 is further attached to the upper lid 11. Accordingly, the circulation passage 4 defined by the channels 8*a* to 8*d* may be easily formed by attaching the upper lid 11 to the liquid tank 3. The heat transfer tube 5 may also be disposed within the predetermined space.

The temperature control devices according to the embodiments of the present invention have been described. It is to be understood that the present invention is not limited to the above-described embodiments, and may have its design arbitrarily modified without departing from the scope of claims of the present invention.

For example, in the first to the fourth embodiments, the heat transfer tube 5 is formed of one or two spiral heat transfer coils. However, the heat transfer tube may be structured to have three or more heat transfer coils.

In the case where the heat transfer tube 5 has three or more layered heat transfer coils, the number of the screening cylinders provided within the liquid tank and/or those attached to the upper lid for increasing the number of channels defined thereby, so as to accommodate the added heat transfer coils.

The invention claimed is:

1. A temperature control device, comprising:

a liquid tank including an upper portion covered by a detachable upper lid, a circulation passage through which constant-temperature fluid circularly flows, and a heat transfer tube provided in the circulation passage, through which a liquid chemical flows such that a heat exchange between the liquid chemical and the constant-temperature fluid is performed via the heat transfer tube for controlling a temperature of the liquid chemical, the circulation passage including a plurality of concentrically layered channels each being screened by concentrically arranging a plurality of screening cylinders configured for screening said channels, said screening cylinders each having a different diameter and being centered around a center axis of the liquid tank, wherein adjacent channels of said plurality of channels are communicated at opposite axial ends thereof alternately, a communication passage that extends along a bottom wall of the liquid tank, and wherein an inner most channel of said plurality of channels is communicated with an outer most channel of said plurality of channels through said communication passage;

a circular screening plate positioned inside said liquid tank, wherein the communication passage is formed between said circular screening plate and a bottom wall of the liquid tank, said screening plate provided above the bottom wall of the liquid tank at a uniform gap and parallel to the bottom wall, wherein an inner circumferential portion of the screening plate connects a lower end of an inner screening cylinder with a first diameter and an outer circumferential portion of the screening plate connects a lower end of an outer screening cylinder with a second diameter;

said plurality of screening cylinders including the inner screening cylinder with the first diameter, the outer screening cylinder with the second diameter larger than the first diameter, and an intermediate screening cylinder with a third diameter intermediate of the first and second diameters, wherein the inner screening cylinder and the outer screening cylinder are directed upwardly and are attached to inner and outer circumferential portions of the screening plate, and wherein the intermediate screening cylinder is directed downwardly and is attached to the upper lid so as to be interposed between the inner screening cylinder and the outer screening cylinder;

said heat transfer tube including an inlet tube end through which a flow of the liquid chemical is accommodated, an outlet tube end through which the liquid chemical is discharged, and at least one spiral heat transfer coil connected to the tube end so as to be concentrically disposed within the channel and which is concentric with the channel; and a pump which is positioned at a center position of a bottom portion of the liquid tank for circulating the constant-temperature fluid along the circulation passage.

2. The temperature control device according to claim 1, wherein a part of the plurality of screening cylinders is disposed in the liquid tank, and a remaining part is attached to said upper lid, and wherein the heat transfer tube is attached to said upper lid.

3. The temperature control device according to claim 2, wherein the heat transfer tube comprises a plurality of concentrically arranged heat transfer coils each having a different diameter, so as to be respectively stored in the plurality of channels of the circulation passage.

4. The temperature control device according to claim 2, further comprising a container filled with the liquid chemical disposed in the screening cylinder at an inner most position, and spaced from an inner surface of the screening cylinder to form a gap for feeding the constant-temperature fluid, and the heat transfer tube includes an inlet tube end which is extended to a position at which the inlet tube end is immersed in the liquid chemical of the container.

5. The temperature control device according to claim 2, wherein the liquid tank comprises a heat exchanger configured to adjust a temperature of the constant-temperature fluid.

6. The temperature control device according to claim 1, wherein the circulation passage is formed of a first channel of said plurality of channels which is located between a side wall of the liquid tank and the outer screening cylinder, a second channel defined by the outer screening cylinder and the intermediate screening cylinder, a third channel defined by the intermediate screening cylinder and the inner screening cylinder, a fourth channel inside the inner screening cylinder, and by the communication passage.

7. The temperature control device according to claim 1, wherein the heat transfer tube comprises a plurality of concentrically arranged heat transfer coils each having a different diameter, so as to be respectively stored in the plurality of channels of the circulation passage.

8. The temperature control device according to claim 1, further comprising a container filled with the liquid chemical disposed in the screening cylinder at an inner most position thereof, and spaced from an inner surface of the screening cylinder to form a gap for feeding the constant-temperature fluid, and the inlet tube end of the heat transfer tube is extended to the position at which the inlet tube end is immersed in the liquid chemical of the container.

9. The temperature control device according to claim 1, wherein the liquid tank comprises a heat exchanger configured to adjust a temperature of the constant-temperature fluid.

* * * * *